US006529092B2

(12) United States Patent
Fuke et al.

(10) Patent No.: US 6,529,092 B2
(45) Date of Patent: Mar. 4, 2003

(54) SUPERCONDUCTOR FILTER AND RADIO TRANSMITTER-RECEIVER

(75) Inventors: Hiroyuki Fuke, Kawasaki (JP); Yoshiaki Terashima, Yokosuka (JP); Mutsuki Yamazaki, Yokohama (JP); Hiroyuki Kayano, Fujisawa (JP); Fumihiko Aiga, Kamakura (JP); Riichi Kato, Histon (GB)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 09/940,502

(22) Filed: Aug. 29, 2001

(65) Prior Publication Data

US 2002/0024404 A1 Feb. 28, 2002

(30) Foreign Application Priority Data

Aug. 30, 2000 (JP) ..... 2000-260996
Jul. 27, 2001 (JP) ..... 2001-228193

(51) Int. Cl.[7] ..... H01P 1/213; H01B 12/07
(52) U.S. Cl. ..... 333/99 S; 505/210; 331/107 S
(58) Field of Search ..... 505/210, 204, 505/211; 333/202, 204, 99 S; 331/107 S

(56) References Cited

U.S. PATENT DOCUMENTS 5,179,074 A * 1/1993 Fiedziuszko et al. ..... 505/210
5,750,473 A * 5/1998 Shen ..... 505/210

FOREIGN PATENT DOCUMENTS

JP 7-202507 8/1995

* cited by examiner

*Primary Examiner*—Patrick Wamsley
(74) *Attorney, Agent, or Firm*—Oblon, Spivak, McClelland, Maier & Neustadt, P.C.

(57) ABSTRACT

A superconductor filter includes a superconductor receiver filter of a planar transmission line structure including a signal input line, a resonator element and a signal output line and configured to select a signal received from an antenna, a superconductor transmitter filter of a planar transmission line structure including a signal input line, a resonator element and a signal output line and configured to select a signal transmitted to the antenna, the transmitter filter being arranged non-parallel to the receiver filter, and a heat-insulating container housing the superconductor receiver filter and the superconductor transmitter filter.

16 Claims, 13 Drawing Sheets

SUPERCONDUCTOR FILTER AND RADIO TRANSMITTER-RECEIVER

CROSS-REFERENCE TO RELATED APPLICATIONS

This application is based upon and claims the benefit of priority from the prior Japanese Patent Applications No. 2000-260996, filed Aug. 30, 2000, and No. 2001-228193, filed Jul. 27, 2001, the entire contents of both of which are incorporated herein by reference.

BACKGROUND OF THE INVENTION

1. Field of the Invention

The present invention relates to a superconductor filter for transmitting-receiving signals used in a radio transmitter-receiver apparatus and a radio transmitter-receiver apparatus using a superconductor filter.

2. Description of the Related Art

In, for example, a radio transmitter-receiver apparatus used in a base station for mobile communication, a receiver filter and a transmitter filter are housed as constituents important for selecting a desired frequency band alone. In general, transmitter signals are generated by dividing into at least two channels and are finally synthesized by using a synthesizer so as to be sent from an antenna. In recent years, a frequency around 2 GHz is used in a mobile communication that is rapidly propagated. However, the frequency band assigned to each carrier is only 20 MHz. In order to use the entire frequency band, it is necessary to attenuate at least 40 dB with a width of 1 MHz. It follows that a filter is required to be excellent in attenuation characteristics and to be low in an insertion loss. For obtaining such a filter, required is a resonator element having a high Q-value.

In addition, an individual amplifying system and a collective amplifying system are known to the art as an amplifying system in the transmitter section of a radio transmitter-receiver apparatus that synthesizes signals of at least two carrier frequencies for transmission.

The individual amplifying system is a system in which sets of signal generator, transmitter amplifier and transmitter filter are prepared in accordance with the number of carrier frequencies used, and the signals of the carrier frequencies outputted from each signal generator are individually amplified by the transmitter amplifiers and allowed to pass through the filters, followed by synthesizing signals in a power synthesizer so as to send the synthesized signals.

The collective amplifying system is a system in which signals of a plurality of carrier frequencies outputted from a plurality of signal generators are synthesized in a power synthesizer, followed by. collectively amplifying the synthesized signals in a single transmitter amplifier and subsequently allowing the amplified signals to pass through a filter and, then, sending the filtered signals.

The individual amplifying system is expected in principle to produce various advantages described below over the collective amplifying system.

Specifically, in the collective amplifying system, signals of a plurality of carrier frequencies simultaneously enter a single amplifier, with the result that mutual interference is brought about among the signals of each carrier frequency. What should be noted is that the power of a distorted signal caused by the mutual interference is likely to give adverse influences to the signal of another carrier frequency. In the individual amplifying system, however, only the signal of one carrier frequency enters a single amplifier, with the result that mutual interference is not brought about among the signals of each carrier frequency. Also, in the individual amplifying system, it is possible to prevent interference caused by turning of the signal of another carrier frequency by setting the pass band of the transmitter filter in the bands corresponding to the separate carrier frequencies. As a result, it is possible to power synthesize easily the signals of each channel in a synthesizer.

In general, in an amplifier, modulation distortion is generated when a modulating signal is amplified, with the result that it is possible for power to leak into the adjacent channel so as to bring about interference with the signal of that channel. Such being the situation, the upper limit of the leaking power into the adjacent channel is determined in the specification. For example, in the modulation system in which signal is contained in the amplitude component like QPSK, the modulation system is backed off and operated at a low efficiency so as to ensure a linearity of the amplifier. In this respect, only the signal of one carrier frequency is allowed to pass through the amplifier in the individual amplifying system so as to suppress the leaking power into the adjacent channel caused by the modulation distortion. It follows that it is possible to operate the amplifier at a high efficiency. Since the power consumption of the amplifier occupies a very large proportion in the entire radio transmitting apparatus, the improvement in the efficiency of the amplifier greatly contributes to the power saving of the radio transmitting apparatus.

In the collective amplifying system, it is possible to achieve about 40% of the maximum efficiency when the allowable maximum channels are contained. However, even where the number of channels used is small, required is power substantially equal to that in the case of using all the channels, leading to low power efficiency. In the individual amplifying system, however, it is possible to turn off the power supplies of the amplifiers for the channels that are not used so as to make effective that channels alone which are being used. It follows that it is possible to achieve the power saving.

It should also be noted that, in the collective amplifying system, the heat generation is concentrated on the amplifier so as to make it necessary to take a large-scale measure for the heat dissipation. In the individual amplifying system, however, a plurality of amplifiers forming heat sources are dispersed, making it unnecessary to take a large scale measure for the heat dissipation.

In order to make the synthesizer simple in construction in the individual amplifying system, it is necessary to use a filter satisfactory in selectivity. It should be noted this connection that it is difficult for the filter of the conventional waveguide type (dielectric cavity resonator type) to meet the required selectivity. On the other hand, the linearity of the amplifier is important in the collective amplifying system in order to avoid the mutual interference among the signals. In recent years, the linearity of the amplifier has been improved by various technical improvements. As a result, the collective amplifying system is used nowadays. However, it is desirable to use the individual amplifying system that has various advantages in principle as described above.

Under the circumstances, proposed in, for example, Japanese Patent Disclosure (Kokai) No. 2000-68958 is the idea of using the individual amplifying system, in which is used a filter comprising resonator elements having a high Q value formed thereon by using a superconductor so as to achieve a sharp cut.

It is conceivable to use a bulk and a thin film for utilizing a superconductor as the conductors of the filter, and it is convenient to use a thin film in view of the cooling method and the freedom of design. In particular, it is well known to the art to form a thin film on a substrate material of a very low loss such as sapphire or MgO and to process the thin film into a planar transmission line. A microstrip line structure, a strip line structure and a coplanar structure are used in many cases as the structure of the planar transmission line. These structures are compact and, thus, are advantageous over the filter structure of the conventional waveguide type (dielectric cavity resonator type).

However, the planar transmission line is exposed to the air in the free space, with the result that the transmitter signal is radiated into the free space so as to possibly give rise to the phenomenon that the electromagnetic field tends to leak from the transmission line. Under the circumstances, where a plurality of filters are arranged adjacent to each other, a serious problem is generated that the undesired radiation and the electromagnetic field leaking from the transmission line of one filter are allowed to interfere with the other filter, resulting in failure to obtain a sufficient SN ratio.

In particularly, in the base station of, for example, a cellular phone, both the transmitter signal and the receiver signal are handled and the transmitting and receiving circuits are arranged very close to each other. What should be noted in this connection is that the intensity of the signal transmitted from the base station is several orders higher than that of the signal received by the base station. It follows that, if the transmitter signal is mixed in the receiving circuit even if only slightly, it is impossible to process normally the received signals. In general, it is necessary to suppress the noise intensity relative to the original received signal intensity at 60 dB (one millionth) or less both inside and outside the receiver signal band. Originally, the undesired frequency (noise) is cut by the receiver filter. However, where a noise is mixed in the receiver filter itself or the transmission line behind, it is impossible to obtain a sufficient SN ratio, making it impossible to process the received signal.

FIG. 1 is a block diagram showing transmitter-receiver filter sections in a base station of, for example, a cellular phone. As shown in the drawing, a transmitter signal of a large power, which is generated from the signal generator 101 and passes through the power amplifier (PA) 102, is transmitted through a transmitter filter 1 and then, sent from the antenna 103. On the other hand, a weak receiver signal incident on the antenna 103 passes through the receiver filter 2. It should be noted that only the receiver signal frequency alone is selectively allowed to pass through the receiver filter 2 and the signal passing through the receiver filter 2 is amplified by the low-noise amplifier (LNA) 104 so as to be transmitted to the latter stage signal processing circuit 105. Since the signal intensity between the receiver filter 2 and the LNA 104 is weak, it is necessary to prevent the mixing of an undesired signal as much as possible. To be more specific, the SN ratio in the receiver filter is required to be at least 60 dB, as described previously.

In the case of employing the filter structure of the conventional waveguide type (dielectric cavity resonator type), the power does not leak from the transmitting circuit because the propagating portions of the microwave signal is covered with an outer wall, with the result that it is substantially unnecessary to worry about the mixing of noise into the receiving circuit. However, the cavity resonator type is a three-dimensional circuit, with the result that the freedom of design is limited and the circuit is rendered bulky. It follows that the filter structure of the cavity resonator type is unsuitable for the structure of a superconductor filter requiring cooling. It should also be noted that it is necessary to cover the entire inner surface of the cavity structure with a superconductor, leading to the problem that the manufacturing cost is increased.

On the other hand, the technology described below is known to the art as the means for alleviating the noise in the filter structure of the planar transmission circuit type.

For example, reported in Japanese Patent Disclosure No. 7-202507 is the structure that a single superconductor filter is housed in a brass case and the inner surface is covered with a radio wave absorber. In the case of this structure, however, it is necessary to prepare the superconductor filters one by one independently and to cover completely the superconductor filter with a brass case and a radio wave absorber. As a result, the filter structure is rendered bulky so as to sacrifice the compactness that is the feature of the planar transmission line. An additional problem is that the number of members that must be cooled is increased so as to increase the heat capacity, with the result that a long time is required for the cooling.

Incidentally, as seen in the recent packaging technology in the personal computer, vigorous studies are being made on an efficient layout that permits a large number of parts not to interfere with each other within a limited volume. However, the transmitting frequency of the signals is only several hundred MHz, or scores of centimeters to several meters in terms of the wavelength, in the personal computer. In other words, the size of each element is sufficiently smaller than the wavelength of the transmitting signal and, thus, the study noted above is directed to the discussion of the layout of the elements formed of a so-called lumped parameter circuit.

On the other hand, where the frequency of the transmitting signal is on the order of GHz like the superconductor filter, the wavelength is not longer than scores of centimeters (or the effective wavelength is not longer than several centimeters in view of the dielectric constant of the substrate constituting the transmission line) and, thus, required is the discussion on the layout of the elements in a so-called distributed parameter circuit. Under the circumstances, it is desirable to establish the packaging technology differing from the packaging technology on the personal computer.

Also, in the radio transmitter-receiver apparatus using a superconductor filter, it is desirable to utilize effectively the transmitting frequency band.

BRIEF SUMMARY OF THE INVENTION

An object of the present invention is to provide a superconductor filter, which is free from interference even if a plurality of superconductor filters of the planar transmission line structure are arranged close to each other so as to obtain a sufficient SN ratio without sacrificing the compactness that is a feature of the planar transmission line structure, and which is excellent in the cooling efficiency.

Another object of the present invention is to provide a radio transmitter-receiver apparatus, which permits obtaining a good received state and is capable of effectively utilizing the transmitting frequency band.

According to one aspect of the present invention, there is provided a superconductor filter, comprising: a superconductor receiver filter of a planar transmission line structure including a signal input line, a resonator element and a signal output line and configured to select a signal received from an antenna; a superconductor transmitter filter of a planar transmission line structure including a signal input line, a resonator element and a signal output line and configured to select a signal transmitted to the antenna, a direction of the transmitter filter being arranged non-parallel to a direction of the receiver filter; and a heat-insulating container housing the superconductor receiver filter and the superconductor transmitter filter.

According to another aspect of the present invention, there is provided a superconductor filter, comprising: a superconductor receiver filter of a planar transmission line structure including a signal input line, a resonator element and a signal output line and configured to select a signal received from an antenna; a superconductor transmitter filter of a planar transmission line structure including a signal input line, a resonator element and a signal output line, and configured to select a signal transmitted to the antenna, the transmitter filter being arranged in a position out of alignment with the receiver filter along a signal transmitting direction; and a heat-insulating container housing the superconductor receiver filter and the superconductor transmitter filter.

According to another aspect of the present invention, there is provided a superconductor filter, comprising: a polyhedral cooling member; a superconductor receiver filter of a planar transmission line structure including a signal input line, a resonator element and a signal output line, and configured to select a signal received from an antenna, the receiver filter being mounted on one surface of the cooling member; a superconductor transmitter filter of a planar transmission line structure including a signal input line, a resonator element and a signal output line, and configured to select a signal transmitted to the antenna, the transmitter filter being mounted on another surface of the cooling member differing from the surface on which the superconductor receiver filter is mounted; and a heat-insulating container housing the cooling member, the superconductor receiver filter and the superconductor transmitter filter.

Further, according to still another aspect of the present invention, there is provided a radio transmitter-receiver apparatus configured to perform communication by using at least two carrier frequencies, comprising: a plurality of radio transmitter-receiver units each including at least one transmitter unit and at least one receiver unit connected in parallel to a single antenna, the transmitter unit including a signal generator generating a signal of one carrier frequency used for communication, an amplifier amplifying the signal of the carrier frequency and a superconductor transmitter filter filtering a signal of a predetermined band from the amplified signal, which are connected in cascade connection, and the receiver unit including a superconductor receiver filter filtering a signal of a predetermined band from a signal of a single carrier frequency received by the antenna and an amplifier amplifying the signal of the predetermined band, which are connected in cascade connection; and a single receiver signal processing circuit to which the receiver units included in the plurality of radio transmitter-receiver units are connected in parallel.

DETAILED DESCRIPTION OF THE INVENTION

Embodiments of the present invention will now be described with reference to the accompanying drawings.

Figure 1:
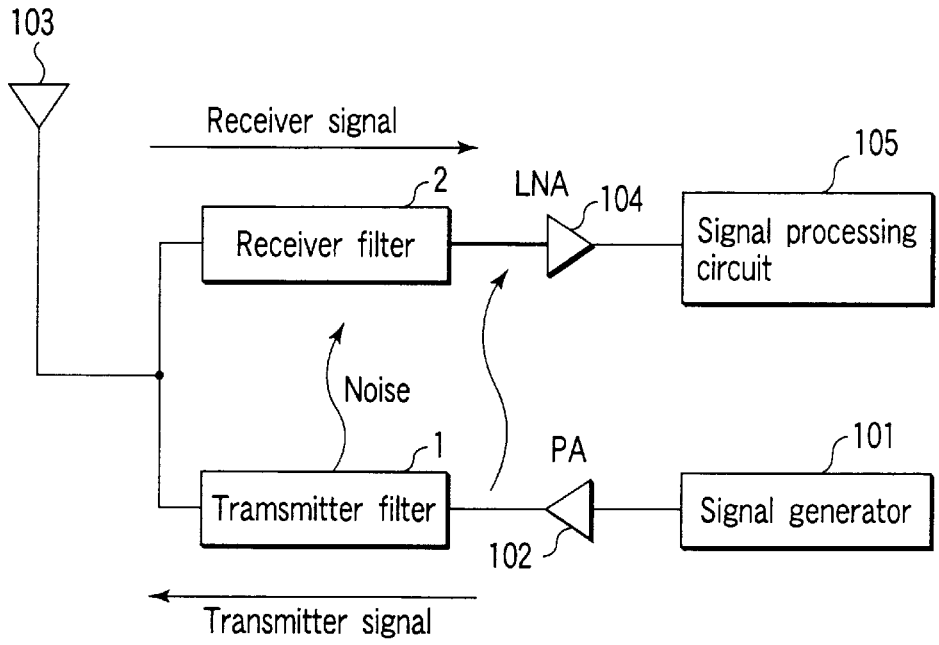
FIG. 1 is a block diagram showing transmitter-receiver sections in a radio communication base station.
Figure 2:
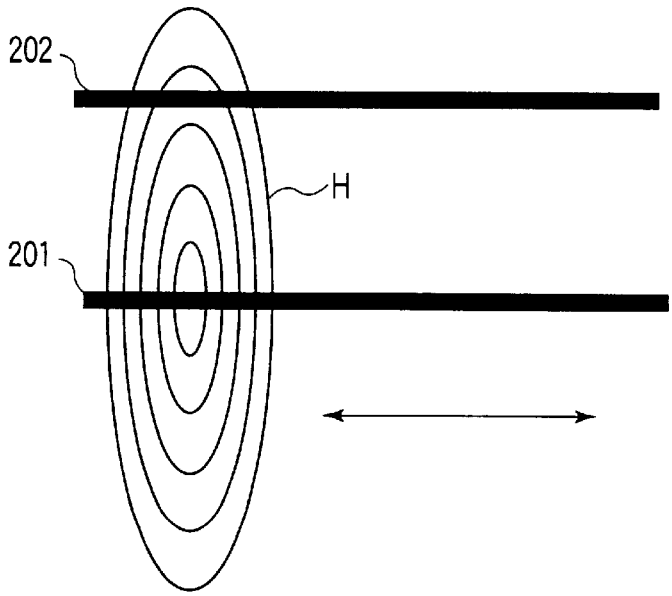
FIG. 2 shows the principle of interference between transmission lines.

First of all, let us describe the principle as to how the transmitter signal is mixed in the receiver filter as noise. The filter is an assembly of resonator elements formed of transmission lines each having a limited length. FIG. 2 shows the state that two transmission lines contained in a transmitter filter and a receiver filter, respectively, are arranged in parallel. In general, the transmission line includes a ground plane and a central conductor, though the ground plane is omitted in the drawing. If a microwave signal passes through the transmission line 201 in a transmitter, current flows in the direction of the transmission line. In this case, a concentric magnetic field H is generated about the center of the transmission line 201 in the transmitter. If the transmission line 202 in a receiver is present in the magnetic field, current is induced in the transmission line 202 in the receiver, which is mixed as noise in the signal transmitted through the transmission line 202 in the receiver.

Figure 3:
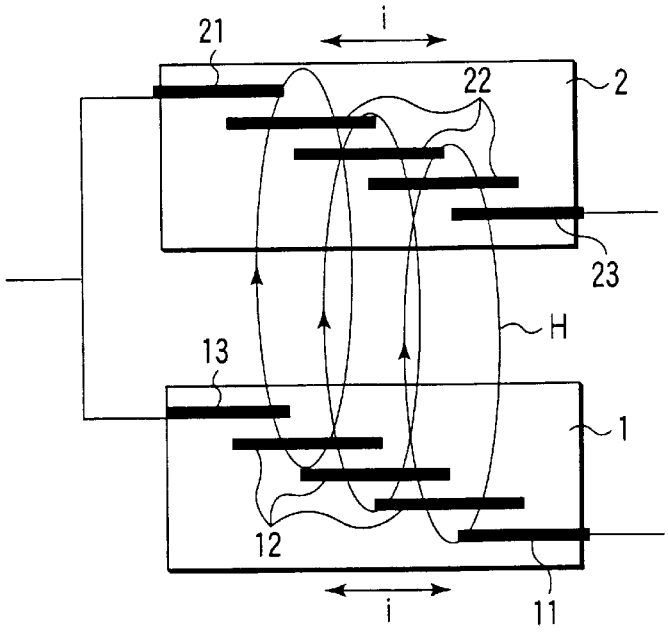
FIG. 3 shows the principle of interference between a transmitter filter and a receiver filter.

It follows that, if there are parallel and juxtaposed portions among a resonator element 22, and signal input/output lines 21, 23 included in the receiver filter 2 and among a resonator element 12 and signal input/output lines 11, 13 included in the transmitter filter 1 as shown in FIG. 3, noise is mixed in the receiver filter 2 under the influence of the magnetic field generated by the transmitter signal.

Figure 4:
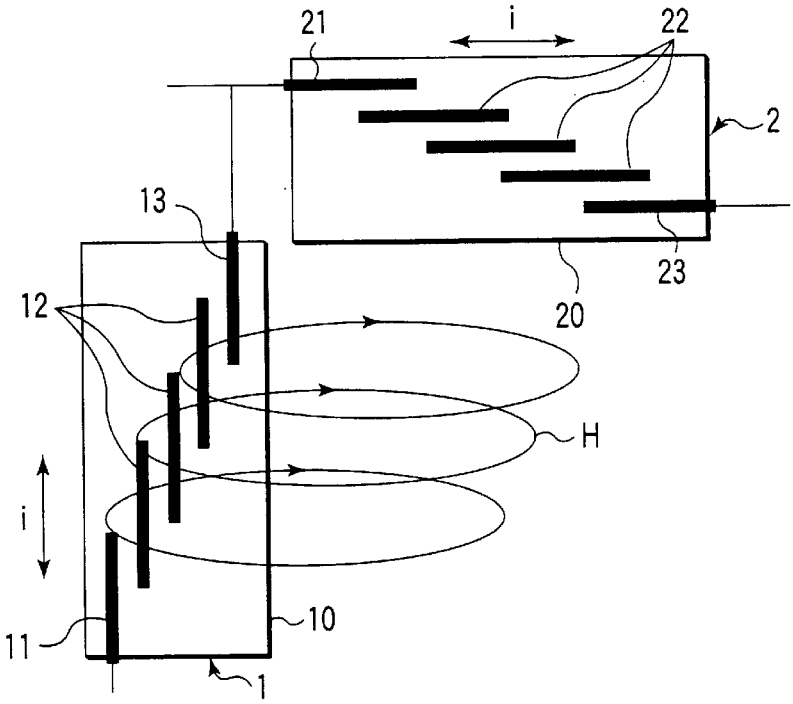
FIG. 4 shows the mounting structure of superconductor filter according to one embodiment of the present invention.

FIG. 4 is a plan view showing a superconductor filter according to one embodiment of the present invention. Each of the transmitter filter 1 and the receiver filter 2 is a band-pass filter of a so-called microstrip line structure. The transmitter filter 1 is formed as follows. Superconductor films are formed on both surfaces of the substrate 10. One surface of the substrate 1 forms a ground conductor (not shown) and the other surface is processed to form the input line 11, the resonator elements 12, and the output line 13 of the transmitter filter 1. Likewise, superconductor films are formed on both surfaces of the substrate 20 of the receiver filter 2. One surface of the substrate 20 forms a ground conductor (not shown), and the other surface is processed to form the input line 21, the resonator elements 22 and the output line 23 of the receiver filter 2. The output line 13 of the transmitter filter is combined with the input line 21 of the receiver filter so as to be connected to an antenna (not shown). The input line 11 of the transmitter filter is connected to a power amplifier (not shown), and the output line 23 of the receiver filter is connected to a low-noise amplifier (not shown). In this superconductor filter, the input line 21, the resonance lines 22 and the output line 23 of the receiver filter are arranged substantially perpendicular to the input line 11, the resonator elements 12 and the output line 13 of the transmitter filter.

In the mounting structure of the superconductor filter shown in FIG. 4, the input line 21, the resonator elements 22 and the output line 23 of the receiver filter are substantially perpendicular to the input line 11, the resonator elements 12 and the output line 13 of the transmitter filter. In other words, there is no portion where the input line 21, the resonator elements 22 and the output line 23 of the receiver filter are parallel and juxtaposed to the input line 11, the resonator elements 12 and the output line 13 of the transmitter filter. As a result, the resonator elements 22 and the output lines 21, 23 of the receiver filter are not put in the magnetic field generated from the output lines 11, 13 and the resonator elements 12 of the transmitter filter, with the result that noise is not mixed. It follows that it is possible to ensure a ratio of the original receiver signal intensity to the noise intensity of 60 dB or more so as to make it possible to process the receiver signal normally.

Figure 5:
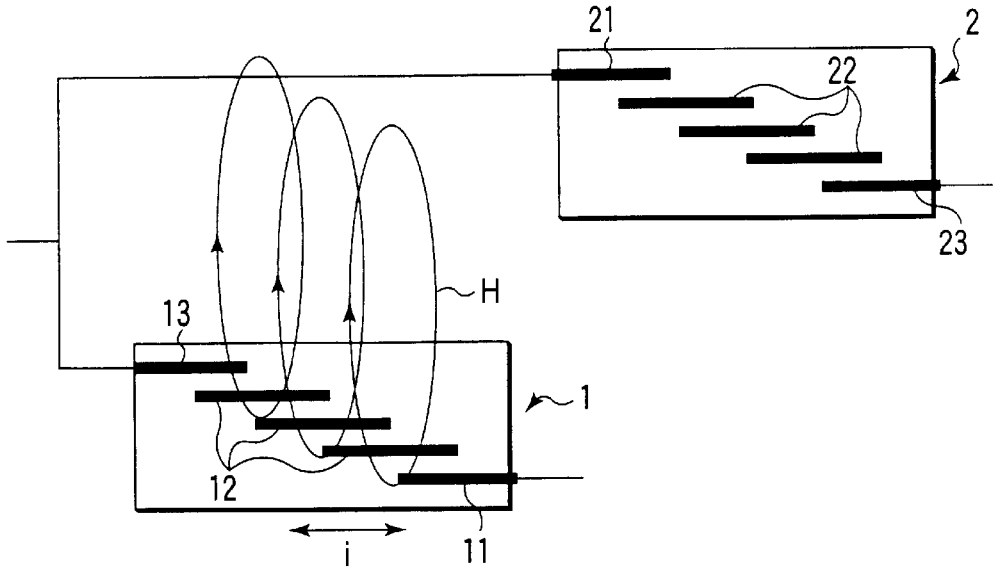
FIG. 5 shows the mounting structure of superconductor filter according to another embodiment of the present invention.

FIG. 5 is a plan view showing a superconductor filter according to another embodiment of the present invention. FIG. 5 is equal to FIG. 4 in respect of the construction of each of the transmitter filter 1 and the receiver filter 2. In the superconductor filter shown in FIG. 5, the input line 21, the resonator elements 22 and the output line 23 of the receiver filter are arranged in positions out of alignment with the input line 11, the resonator elements 12 and the output line 13 of the transmitter filter along the signal transmitting direction.

In the mounting structure of the superconductor filter shown in FIG. 5, there is no portion where the input line 21, the resonator elements 22 and the output line 23 of the receiver filter are arranged in parallel and juxtaposed to the input line 11, the resonator element 12 and the output line 13 of the transmitter filter. It follows that the arrangement shown in FIG. 5 produces the effect substantially equal to that produced by the arrangement shown in FIG. 4.

In the mounting structure of the superconductor filter according to the embodiments of the present invention, it is unnecessary to mount particularly a shield made of a metal plate or a radio wave absorber. Therefore, the mounting structure is advantageous in that the heat capacity of the filter portions to be cooled is relatively small so as to make it possible to use a small refrigerator and to shorten the cooling time.

As described above, according to the embodiments of the present invention, interference is not generated even if the superconductor filters of a planar transmission line structure are arranged close to each other so as to obtain a sufficient SN ratio. In addition, the compactness that is a feature of the planar transmission line structure is not sacrificed so as to make it possible to provide a mounting structure of a superconductor filter excellent in its cooling efficiency.

Incidentally, a band-pass filter of three steps is employed in the embodiment shown in each of FIGS. 4 and 5. Needless to say, however, it is possible to use a filter of other steps in the present invention. Also, linear resonator elements are used in the embodiment shown in each of FIGS. 4 and 5. However, it is possible for the resonator elements to include a curved portion. Needless to say, the type of the filter is not limited to the band-pass filter. It is also possible to use filters of other types such as a band rejection filter, a low-pass filter and a high-pass filter. Also, the filter configuration featuring the manner of coupling need not be limited to the side couple type. It is also possible to use other types such as an end couple type. Also, when it comes to the planar transmission line structure, the structure is not limited to the microstrip line structure. For example, it is also possible to employ a strip line structure and a coplanar structure. Further, the transmitter filter and the receiver filter need not be equal to each other in the pattern. For example, it is conceivable to use a disk resonator type structure, which is durable against a high power, for the transmitter filter and a comb line structure, which can be easily formed in the form of multi-steps, for the receiver filter.

Let us describe a superconductor filter according to another embodiment of the present invention, which permits preventing change in characteristics derived from uneven temperature distribution in a cooling member. The cooling member herein means a cold head connected to a refrigerator, a cooling plate mounted directly to the cold head or mounted to the cold head with a connecting member, or a filter holding member mounted to the cooling plate, which is mounted to the cold head.

Unevenness of temperature distribution of the cooling member will now be described. In general, a single superconductor receiver filter and at least one superconductor transmitter filters are connected in parallel to a synthesizer connected to a single antenna. It is necessary to cool these filters to 77K or lower. If these filters are arranged on a cooling plate having a large area in order to cool these filters by using a single refrigerator, uneven temperature distribution tends to take place within the plane of the cooling plate in the case where the area of the cooling plate is large relative to the cold head of the refrigerator. As a result, cooling conditions are caused to differ depending on the mounting positions of the filters, resulting in failure to obtain filter characteristics as designed.

On the other hand, where a single receiver filter and at least one transmitter filters are arranged at positions in rotational symmetry with respect to the lowest or highest temperature point on the planar cooling member, it is possible to make the cooling conditions of the filters equal to each other. Therefore, if a single filter is designed in view of the temperature gradient, the other filter is also operated as designed. It follows that it is possible to prevent the change in the filter characteristics of the superconductor filter derived from the uneven temperature distribution of the cooling member. In addition, if the signal input/output lines of the receiver filter and the signal input/output lines of the transmitter filter are arranged substantially perpendicular to each other, the receiver filter does not enter the magnetic field generated from the transmitter filter so as to prevent noise mixing.

Also, if a single receiver filter and at least one transmitter filters are mounted on different surfaces of a cooling member forming a polyhedral body, it is possible to make the cooling conditions of the filters equal to each other. It is possible to prevent the change in the filter characteristics of the superconductor filters derived from the uneven temperature distribution of the cooling member in this case, too.

Further, in any of the superconductor filters described above, if the receiver filter and the transmitter filter are arranged in parallel through a synthesizer consisting of a superconductor, it is possible to eliminate heat generation in the synthesizer and to achieve a low loss.

Let us describe in the following a radio transmitter-receiver apparatus using at least two carrier frequencies according to another embodiment of the present invention.

Specifically, the radio transmitter-receiver apparatus comprises a plurality of radio transmitter-receiver units and a single receiver signal processing circuit to which a plurality of receiver units included in the plural radio transmitter-receiver units are connected in parallel. It should be noted that each of the radio transmitter-receiver units includes at least one transmitter unit and a receiver unit connected in parallel to a single antenna. The transmitter unit includes a signal generator generating a signal of one carrier frequency used in communication, an amplifier amplifying the signal of the carrier frequency, and a superconductor transmitter filter for selectively passing a signal of a predetermined band selected from the amplified signals, which are connected in cascade connection. On the other hand, the receiver unit includes a superconductor receiver filter for selectively passing a signal of a predetermined band selected from the signals of one carrier frequency received by an antenna and an amplifier amplifying the signal of a predetermined band, which are connected in cascade connection. It is possible for the radio transmitter-receiver apparatus to conform to a diversity system capable of selecting the radio transmitter-receiver unit that is satisfactory in the received state.

In the radio transmitter-receiver apparatus of the construction described above, it is desirable to prepare a radio transmitter-receiver unit including two transmitter units connected in parallel and a single receiver unit and to make the carrier frequency bands used in the two transmitter units different from each other such that the high frequency edge of the two carrier frequency bands is apart from the low frequency edge by at least about 500 kHz, preferably about 1 MHz.

The reason for the particular condition is as follows. Specifically, distortion dependent on the performance of the amplifier is superposed on the signal amplified in each transmitter unit. Unless a filter removes the distortion, interference takes place when the transmitter signals formed in the two transmitter units are synthesized in a synthesizer. In the cellular phone system available nowadays, a band of 20 MHz is divided into a plurality of channels each having a band of 5 MHz for transmission. Therefore, where the high frequency edge of one channel is not apart from the low frequency edge of another channel, a superconductor filter having very sharp skirt characteristics is required. However, there is a limit for realizing such characteristics. Such being the situation, it is desirable for the carrier frequency bands passing through the superconductor transmitter filters connected in parallel to a single synthesizer to have a separation of at least about 500 kHz, preferably about 1 MHz.

It should be noted, however, that it is desirable to cope with the increase in users by avoiding the generation of an unused frequency band. For achieving this purpose, where, for example, a band of 20 MHz is divided into four bands each having a bandwidth of 5 MHz, it is possible to select and use two carrier frequencies having the high frequency edge and the low frequency edge apart from each other by 5 MHz in the two transmitter units included in each radio transmitter-receiver unit. In this case, it is possible to effectively utilize the transmitting frequency band.

Further, it is desirable to employ the construction of the superconductor filter described above in the radio transmitter-receiver apparatus.

EXAMPLES

Examples of the present invention will now be described.

Example 1

Let us describe an example of manufacturing the superconductor filter shown in FIG. 4. Each of the transmitter filter 1 and the receiver filter 2 in this example is formed of a three-step band-pass filter of a microstrip line structure. Since the manufacturing process of the transmitter filter 1 is equal to that of the receiver filter 2, the manufacturing method of the transmitter filter 1 will now be described as the representative. In the first step, a YBCO superconductor film having a thickness of about 500 nm is formed on both surfaces of the $LaAlO_3$ single crystal substrate 10 having a length of 40 mm, a width of about 20 mm and a thickness of about 0.5 mm by, for example, a sputtering method, a laser vapor deposition method or a CVD method. Then, processing the superconductor film on one surface by employing a lithography method forms the input-output lines 11, 13 and the resonator elements 12. The superconductor film on the back surface (not shown) is used as it is as a ground plane. Each of the resonator elements 12 has a width of about 170 $\mu$m and a length of about 18 mm. The distance between the transmission lines used as the resonator elements 12 is about 1 mm, and the distance between the resonator elements 12 and the input or output line 11 or 13 is about 500 $\mu$m. The filter is formed of a band-pass filter having a center frequency of 1.92 GHz and a pass bandwidth of 20 MHz. The receiver filter 2 has a specification equal to that of the transmitter filter 1. Then, the transmitter filter 1 and the receiver filter 2 are fixed to a copper base (not shown) plated with gold in the layout that the resonator elements and the input-output lines of the transmitter filter 1 are substantially perpendicular to the resonator elements and the input-output lines of the receiver filter 2, as shown in FIG. 4, followed by setting the resultant structure within a heat-insulating container (not shown).

Actual transmitter-receiver signals are passed through the superconductor filter thus fabricated with the temperature within the heat-insulating container lowered to about 60 K. Noise is scarcely mixed in the output of the receiver filter so as to ensure an SN ratio not smaller than 60 dB.

Incidentally, the transmitter filter and the receiver filter are prepared separately in Example 1. However, it is possible to form the transmitter filter and the receiver filter on the same substrate. In this case, it is possible for the line leading from the junction between the output line 13 of the transmitter filter and the input line 21 of the receiver filter to an antenna (not shown) to be formed of a superconductor so as to suppress a loss due to a resistance, compared with the ordinary metal wiring.

Comparative Example 1

A superconductor filter as shown in FIG. 3 is fabricated. Specifically, the transmitter filter 1 and the receiver filter 2 fabricated as in Example 1 are fixed to a copper base (not shown) plated with gold in the layout that there is a portion where the resonator elements and the input-output lines of the transmitter filter 1 are parallel to the resonator elements and the input-output lines of the receiver filter 2 as shown in FIG. 3, followed by setting the resultant structure within a heat-insulating container (not shown).

Actual transmitter-receiver signals are passed through the superconductor filter thus fabricated with the temperature within the heat-insulating container lowered to about 60 K. It is found that noise from the transmitter filter circuit is mixed in the output of the receiver filter and the SN ratio is only 30 dB.

Example 2

A superconductor filter as shown in FIG. 5 is prepared. Specifically, the transmitter filter 1 and the receiver filter 2 prepared as in Example 1 are fixed to a copper base (not shown) plated with gold in the layout that the resonator elements 12 and the input-output lines 11, 13 of the transmitter filter 1 are parallel to but deviated in the signal transmitting direction from the resonator elements 22 and the input-output lines 21, 23 of the receiver filter 2 so that they are not juxtaposed side by side as shown in FIG. 5, followed by setting the resultant structure in a heat-insulating container (not shown). Incidentally, a coaxial cable is used as the cable (not shown) connected to the input line 11 of the transmitter filter 1 and, thus, a radio wave does not leak from the cable.

Actual transmitter-receiver signals are passed through the superconductor filter thus prepared with the temperature within the heat-insulating container lowered to about 60 K. Noise is scarcely mixed in the output of the receiver filter so as to ensure an SN ratio not smaller than 60 dB.

Example 3

Figure 6:
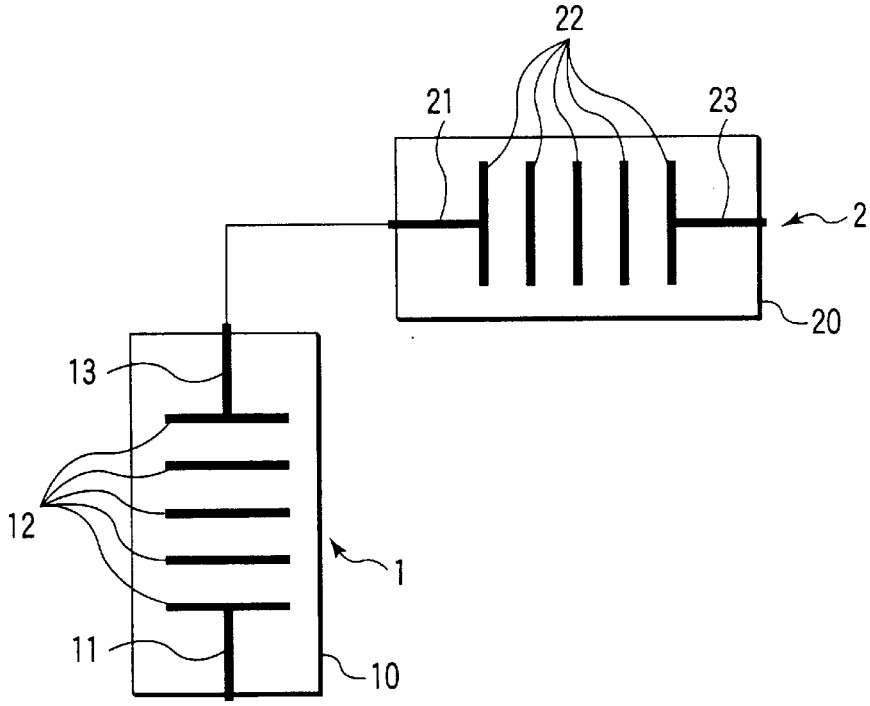
FIG. 6 shows the mounting structure of a superconductor filter in Example 3 of the present invention.

Prepared is a superconductor filter shown in FIG. 6. The construction of each of the transmitter filter 1 and the receiver filter 2 in this Example is called a forward couple structure. These transmitter filter 1 and receiver filter 2 are prepared by the method similar to that employed in Example 1. Each of the resonator elements has a width of about 170 $\mu$m and a length of about 18 mm. The distance between the transmission lines used as the resonator elements is about 4 mm, and the outer resonator elements are connected to the input-output lines at right angles.

Then, these transmitter filter 1 and receiver filter 2 are fixed to a copper base (not shown) plated with gold in the layout that the resonator elements and the input-output lines of the transmitting filer 1 are perpendicular to the resonator elements and the input-output lines of the receiver filter 2, respectively, as shown in FIG. 6, followed by setting the resultant structure in a heat-insulating container (not shown).

Actual transmitter-receiver signals are passed through the superconductor filter thus prepared with the temperature within the heat-insulating container lowered to about 60 K. Noise is scarcely mixed in the output of the receiver filter so as to ensure an SN ratio not smaller than 60 dB.

Comparative Example 2

Figure 7:
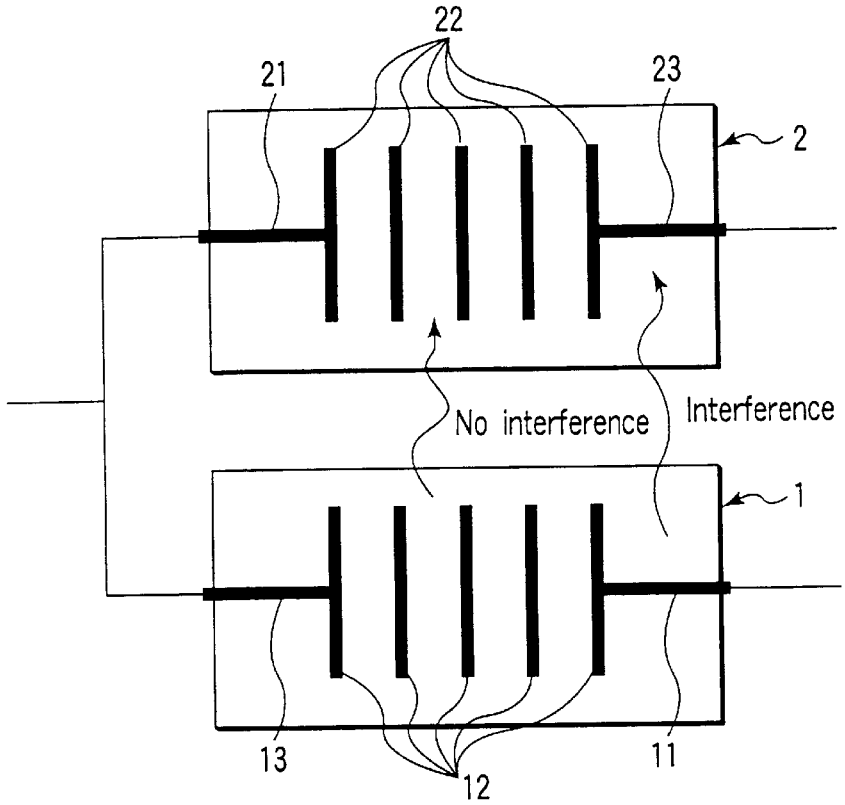
FIG. 7 shows the mounting structure of a superconductor filter in Comparative Example 2.

A superconductor filter as shown in FIG. 7 is prepared. Specifically, the transmitter filter 1 and the receiver filter 2 prepared as in Example 3 are fixed to a copper base (not shown) plated with gold in the layout that the resonator elements of the transmitter filter 1 are parallel but not juxtaposed to the resonator elements of the receiver filter 2, and that the input-output lines of the transmitter filter 1 and the receiver filter 2 have parallel and juxtaposed portions, as shown in FIG. 7, followed by setting the resultant structure in a heat-insulating container (not shown).

Actual transmitter-receiver signals are passed through the superconductor filter thus prepared with the temperature within the heat-insulating container lowered to about 60 K. Noise from the transmitter filter circuit is found in the output of the receiver filter and the SN ratio is only 40 dB.

Example 4

Figure 8:
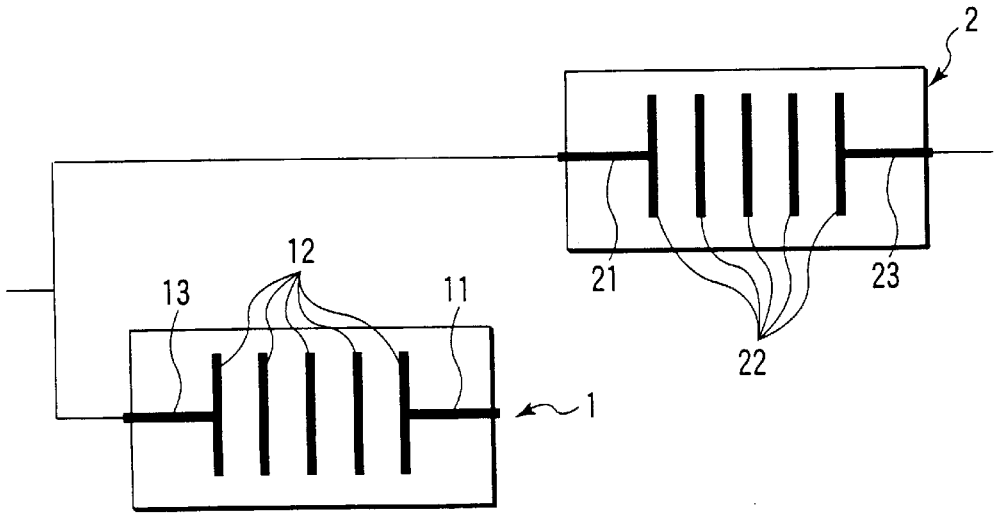
FIG. 8 shows the mounting structure of a superconductor filter in Example 4 of the present invention.

A superconductor filter as shown in FIG. 8 is prepared. Specifically, the transmitter filter 1 and the receiver filter 2 prepared as in Example 3 are fixed to a copper base (not shown) plated with gold in the layout that the resonator elements 12 and the input-output lines 11, 13 of the transmitter filter 1 are parallel to the resonator elements 22 and the input-output lines 21, 23 of the receiver filter 2, respectively, but the transmitter filter 1 itself and the receiver filter 2 itself are deviated from each other along the signal transmitting direction as shown in FIG. 8, followed by setting the resultant structure in a heat-insulating container (not shown). Incidentally, a coaxial cable is used as the cable (not shown) connected to the input line 11 of the transmitter filter 1 and, thus, a radio wave does not leak from the cable.

Actual transmitter-receiver signals are passed through the superconductor filter thus prepared with the temperature within the heat-insulating container lowered to about 60 K. Noise is scarcely mixed in the output of the receiver filter so as to ensure an SN ratio not smaller than 60 dB.

Example 5

Figure 9:
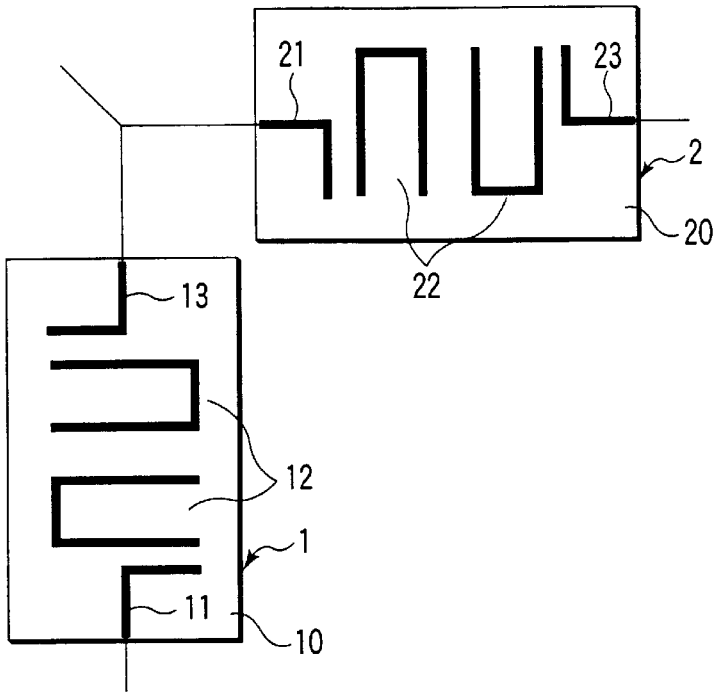
FIG. 9 shows the mounting structure of a superconductor filter in Example 5 of the present invention.

Prepared is a superconductor filter as shown in FIG. 9. The construction of the transmitter filter 1 and the receiver filter 2 in Example 9 is generally called a comb line. The transmitter filter 1 and the receiver filter 2 are prepared by the method as in Example 1. The resonator element has a width of about 170 $\mu$m and a length of about 18 mm and is folded in a U-shape. The distance between the transmission lines used as the resonator elements is about 3 mm and the distance between the resonator elements and the input-output lines is about 1 mm. Also, the input-output lines are bent at 90°. Then, these transmitter filter 1 and receiver filter 2 are fixed to a copper base (not shown) plated with gold in the layout shown in FIG. 9, followed by setting the resultant structure in a heat-insulating container (not shown). To be more specific, the transmitter filter 1 and the receiver filter 2 are set in two quadrants that are not adjacent to each other when the two dimensional plane is divided into four quadrants. As a result, the mounting structure is constructed such that the resonator elements 22 and the signal input-output lines 21, 23 of the receiver filter 2 are not parallel and juxtaposed to the resonator elements 12 and the signal input-output lines 11, 13 of the transmitter filter 1, respectively.

Actual transmitter-receiver signals are passed through the superconductor filter thus prepared with the temperature within the heat-insulating container lowered to about 60 K. Noise is scarcely mixed in the output of the receiver filter so as to ensure an SN ratio not smaller than 60 dB.

Incidentally, the resonator elements need not be folded at an angle of 90°. The resonator elements may be folded at an arbitrary angle or may be curved. This is also the case with the bending manner of the signal input-output lines.

Also, it is not absolutely necessary to arrange the transmitter filter and the receiver filter in a two dimensional plane. It is also possible to arrange the transmitter filter and the receiver filter three-dimensionally as far as the resonator elements and the signal input-output lines of the receiver filter are not parallel and juxtaposed to the resonator elements and the signal input-output lines of the transmitter filter.

Comparative Example 3

Figure 10:
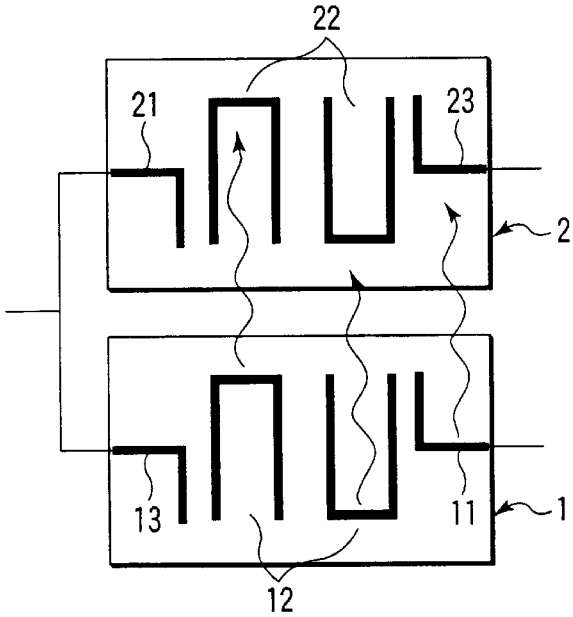
FIG. 10 shows the mounting structure of a superconductor filter in Comparative Example 3.

A superconductor filter as shown in FIG. 10 is prepared. Specifically, the transmitter filter 1 and the receiver filter 2 prepared as in Example 5 are fixed to a copper base (not shown) plated with gold in the layout that the resonator elements and the input-output lines of the transmitter filter are parallel and juxtaposed to the resonator elements and the input-output lines of the receiver filter, as shown in FIG. 10, followed by setting the resultant structure in a heat-insulating container (not shown).

Actual transmitter-receiver signals are passed through the superconductor filter thus prepared with the temperature within the heat-insulating container lowered to about 60 K. Noise from the transmitter filter circuit is mixed in the output of the receiver filter, and the SN ratio is only 30 dB.

Comparative Example 4

Figure 11:
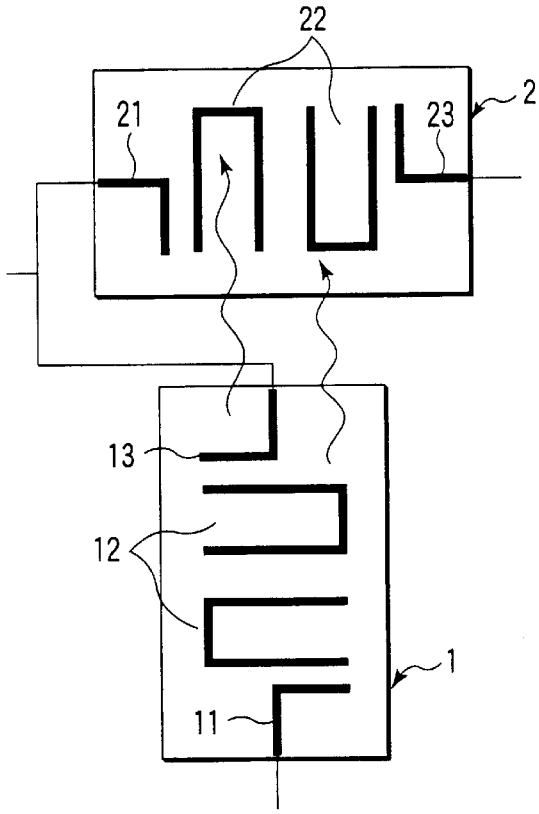
FIG. 11 shows the mounting structure of a superconductor filter in Comparative Example 4.

Prepared is a superconductor filter as shown in FIG. 11. Specifically, the transmitter filter 1 and the receiver filter 2 prepared as in Example 5 are fixed to a copper base (not shown) plated with gold in the layout that the resonator elements and the input-output lines of the transmitter filter are partly parallel and juxtaposed to the resonator elements and the input-output lines of the receiver filter, respectively, as shown in FIG. 11.

Actual transmitter-receiver signals are passed through the superconductor filter thus prepared with the temperature within the heat-insulating container lowered to about 60 K. Noise from the transmitter filter circuit is mixed in the output of the receiver filter, and the SN ratio is only 30 dB.

Comparative Example 5

Figure 12:
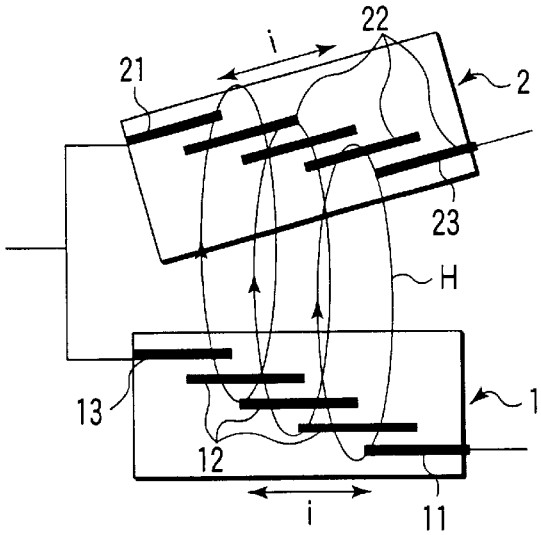
FIG. 12 shows the mounting structure of a superconductor filter in Comparative Example 5.

Prepared is a superconductor filter as shown in FIG. 12. Specifically, the transmitter filter 1 and the receiver filter 2 prepared as in Example 1 are fixed to a copper base (not shown) plated with gold in the layout that the transmitter filter and the receiver filter are arranged side by side with a small angle formed between the transmitter filter and the receiver filter, as shown in FIG. 12.

Actual transmitter-receiver signals are passed through the superconductor filter thus prepared with the temperature within the heat-insulating container lowered to about 60 K. Noise from the transmitter filter circuit is mixed in the output of the receiver filter, and the SN ratio is only 45 dB. The poor experimental data is derived from the construction that there are parallel and juxtaposed components between the resonator elements and the input-output lines of the transmitter filter and the resonator elements and the input-output lines of the receiver filter.

Example 6

Figure 13:
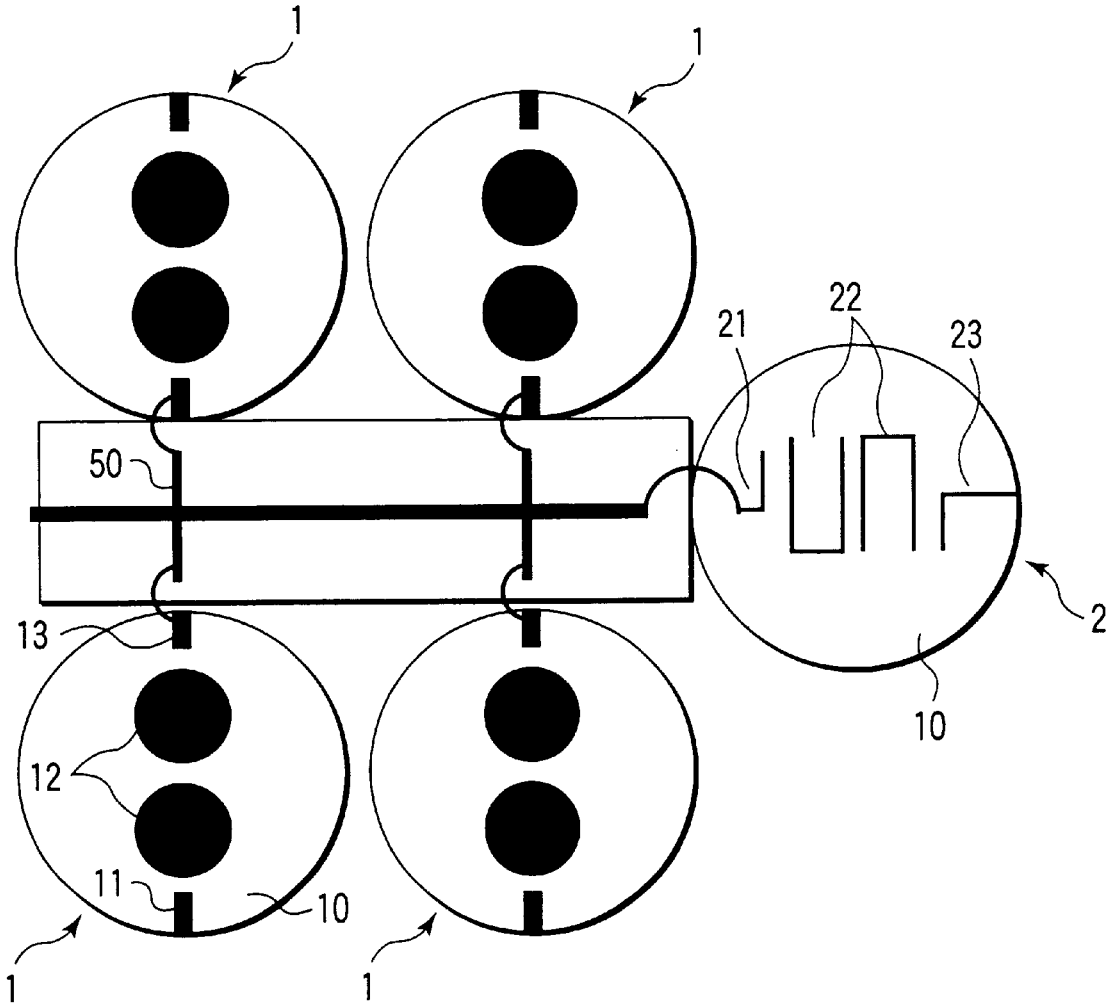
FIG. 13 shows the mounting structure of a superconductor filter in Example 6 of the present invention.

Prepared is a superconductor filter as shown in FIG. 13. Specifically, four transmitter filters 1 and one receiver filter 2 each constructed as shown in FIG. 13 are prepared by the method equal to that employed in Example 1. The transmitter filter 1 has a so-called disk resonator element structure, and the transmitting direction in the resonator elements can be regarded as being equal to the direction of the signal input-output lines. The receiver filter 2 has a comb line structure.

These transmitter filters 1 and receiver filter 2 are arranged in the layout shown in FIG. 13. Specifically, the transmitter filters 1 formed two pairs and the receiver filter 2 is positioned sideward of the two pairs of the transmitter filters 1, and the output lines 13 of the transmitter filters 1 are connected to the input line 21 of the receiver filter 2 by a superconductor wire 50. In this layout, the resonator elements and the input-output lines of the paired transmitter filters 1 are parallel to each other, respectively. However, the resonator elements and the input-output lines of the transmitter filters 1 are not parallel and juxtaposed to the resonator elements and the input-output lines of the receiver filter 2, respectively.

Actual transmitter-receiver signals are passed through the superconductor filter thus prepared with the temperature within the heat-insulating container lowered to about 60 K. Noise is scarcely mixed in the output of the receiver filter so as to ensure an SN ratio not smaller than 60 dB.

In this Example, the four transmitter filters 1 and the single receiver filter 2 are prepared separately and connected to each other by using the other superconductor wire 50. The particular construction makes it possible to use a small substrate material that is relatively cheap, compared with the method of forming all the transmitter and receiver filters within a large single substrate, so as to permit manufacturing the filter at a low cost.

Of course, it is possible to form all the filters on a large single substrate. This method is defective in that the manufacturing cost is increased, compared with the case of using a plurality of small substrates. However, it is possible for the line leading from the junction between the output lines 13 of the transmitter filters 1 and the input line 21 of the receiver filter 2 to the antenna (not shown) to be formed simultaneously by using the same superconductor, leading to the merit that it is possible to suppress a loss due to a resistance, compared with the case of arranging lines made of a metal. It is desirable to select on the case by case basis whether the transmitter filters and the receiver filter are formed on a single substrate or whether a plurality of substrates are combined by comparing the cost and the characteristics.

Example 7

Figure 14A:
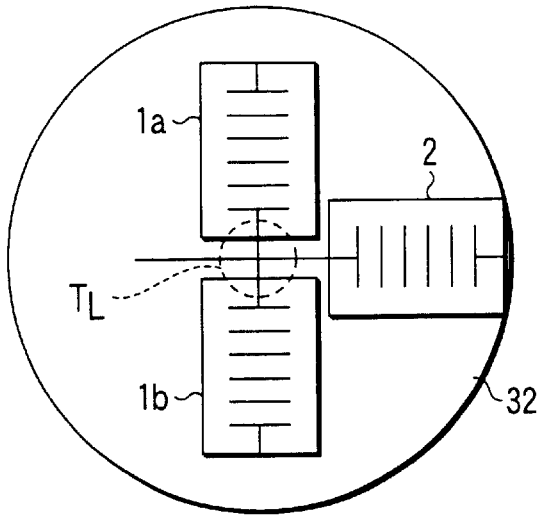
FIG. 14A is a plan view showing the arrangement of a cold head, a cooling plate, a transmitter filter, and a receiver filter in Example 7 of the present invention.
Figure 14B:
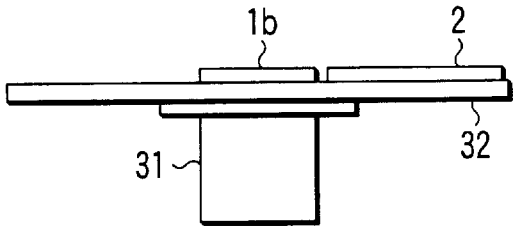
FIG. 14B is a side view of the arrangement shown in FIG. 14A.

Prepared is a superconductor filter as shown in FIGS. 14A and 14B. FIG. 14A is a plan view showing the arrangement of a cold head, a cooling plate and a filter, and FIG. 14B is a side view of the arrangement shown in FIG. 14A.

Transmitter filters 1*a* and 1*b* are prepared as follows. Specifically, a YBCO superconductor film having a thickness of about 500 nm is formed on each surface of a $LaAlO_3$ single crystal substrate sized at about 40 mm×about 20 mm×about 0.5 mm by a sputtering method, a laser vapor deposition method or a CVD method. Then, the superconductor film on one surface is processed by a lithography method so as to form input-output lines and resonator elements. The superconductor film on the back surface (not shown) is used as it is as a ground plane. Each of these filters is a band-pass filter having a center frequency of 1.92 GHz and a pass bandwidth of 20 MHz. The receiver filter 2 is equal in the specification to the transmitter filters 1*a*, 1*b*.

As shown in FIGS. 14A and 14B, the cooling plate 32 made of copper plated with gold is disposed on the cold head 31. In FIG. 14A, $T_L$ denotes the position of the lowest temperature on the cooling plate 32 corresponding to the position of the cold head 31. The transmitter filters 1*a*, 1*b* and the receiver filter 2 are fixed to the cooling plate 32 at the positions in rotational symmetry with respect to the position $T_L$ of the lowest temperature with a rotating angle of 90°, and the resultant structure is set in a heat-insulating container (not shown). As a result, it is possible to make the filters equal to each other in the cooling conditions. In this case, the resonator elements and the input-output lines of the transmitter filters 1*a*, 1*b* are perpendicular to the resonator elements and the input-output lines of the receiver filter 2.

Actual transmitter-receiver signals are passed through the superconductor filter thus fabricated with the temperature within the heat-insulating container lowered to about 60 K. Noise is scarcely mixed in the output of the receiver filter so as to ensure an SN ratio not smaller than 60 dB.

In this Example, the transmitter filters and the receiver filter are formed on different substrates. However, it is also possible to form the transmitter filters and the receiver filter on the same substrate. In this case, it is possible for a line leading from the junction between the output lines of the transmitter filters and the input line of the receiver filter to the antenna (not shown) to be formed of a superconductor so as to suppress a loss due to a resistance, compared with the case where the line noted above is formed of a metal.

Comparative Example 6

Figure 15:
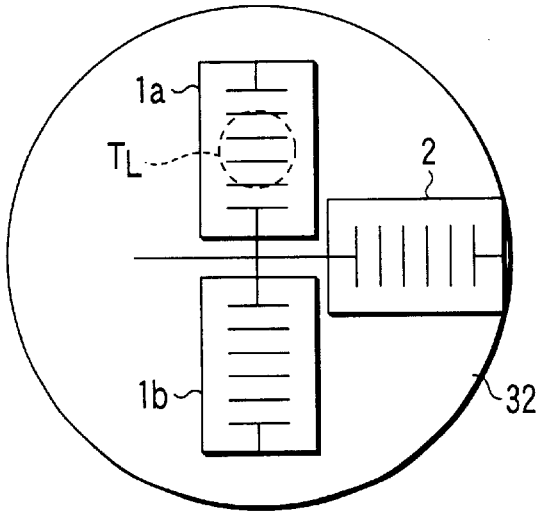
FIG. 15 is a plan view showing the arrangement of a cooling plate, a transmitter filter, and a receiver filter in Comparative Example 6.

FIG. 15 is a plan view corresponding to FIG. 14A. $T_L$ denotes the position of the lowest temperature on the cooling plate 32 corresponding to the position of the cold head 31. FIG. 15 is equal to FIG. 14A in the arrangement of the transmitter filters 1*a*, 1*b* and the receiver filter 2. However, the position $T_L$ of the lowest temperature is not in the center of the cooling plate 32 and, thus, the transmitter filters 1*a*, 1*b* and the receiver filter 2 are not in rotational symmetry with respect to the position $T_L$ of the lowest temperature.

In this case, the temperature of the receiver filter 2 is higher than the designed operating temperature, resulting in failure to obtain desired pass characteristics. Also, the transmitter filters 1*a* and 1*b* are different from each other in temperature, resulting in failure to achieve signal transmission as designed.

Example 8

Figure 16A:
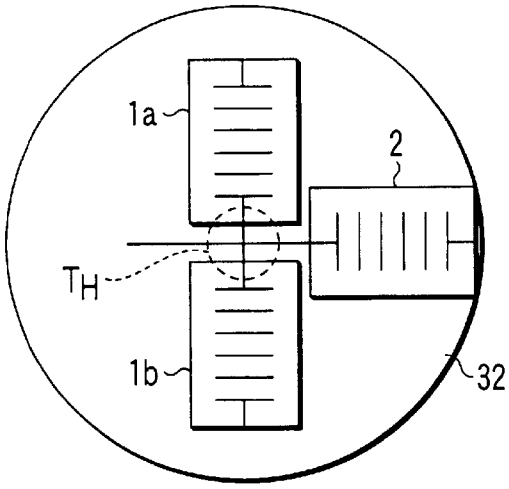
FIG. 16A is a plan view showing the arrangement of a cold head, a cooling plate, a transmitter filter, and a receiver filter in Example 8 of the present invention.
Figure 16B:
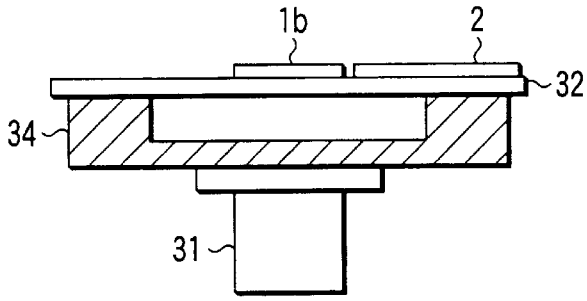
FIG. 16B is a side view of the arrangement shown in FIG. 16A.

Prepared is a superconductor filter as shown in FIGS. 16A and 16B. FIG. 16A is a plan view showing the arrangement of a cold head, a cooling plate and a filter, and FIG. 16B is a side view of the arrangement shown in FIG. 16A.

Specifically, the transmitter filters 1*a*, 1*b* and the receiver filter 2 are prepared as in Example 7. As shown in FIGS. 16A and 16B, the cooling plate 32 made of copper plated with gold is disposed on the cold head 31 with a connecting member 34 having an annular upper portion and a central recess. In this case, the position $T_H$ of the highest temperature is in the central portion of the cooling plate 32. The transmitter filters 1*a*, 1*b* and the receiver filter 2 are fixed to the cooling plate 32 at the positions in rotational symmetry by 90° with respect to the position $T_H$ of the highest temperature, followed by setting the resultant structure in a heat-insulating container (not shown). In this case, the resonator elements and the input-output lines of the transmitter filters 1*a*, 1*b* are perpendicular to the resonator elements and the input-output lines of the receiving filer 2. The effect similar to that obtained in Example 7 is obtained in this Example, too.

Example 9

Figure 17:
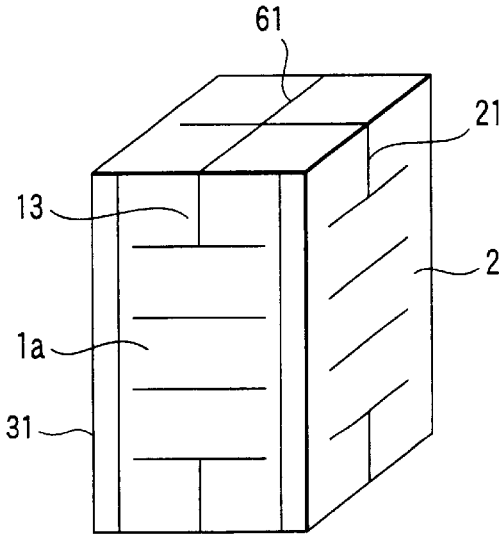
FIG. 17 is a perspective view showing a cold head equipped with a transmitter filter and a receiver filter in Example 9 of the present invention.

Prepared is a superconductor filter as shown in FIG. 17, which is a perspective view showing a cold head having a filter formed on the side surfaces.

Specifically, the transmitter filters 1*a*, 1*b* and the receiver filter 2 are prepared as in Example 7. As shown in FIG. 17, the transmitter filters 1*a*, 1*b* and the receiver filter 2 are mounted to the three side surfaces of the cold head 31, which is a parallelepiped. Incidentally, the transmitter filter 1*b* is mounted to the side surface of the cold head 31 opposite to the side surface to which the transmitter filter 1*a* is mounted and, thus, is concealed from view. Also, after formation of a YBCO superconductor film on each surface of a $LaAlO_3$ single crystal substrate, the superconductor film on one surface is processed by a lithography method so as to form the synthesizer 61. The synthesizer 61 thus formed is mounted to the upper surface of the cold head 31 and connected to the output lines 13 of the transmitter filters 1*a*, 1*b* and to the input line 21 of the receiver filter 2. The particular construction permits shortening the wiring. In addition, the synthesizer 61 is formed of a superconductor. It follows that it is possible to suppress a loss due to a resistance, compared with the case of a metal wiring.

Figure 18:
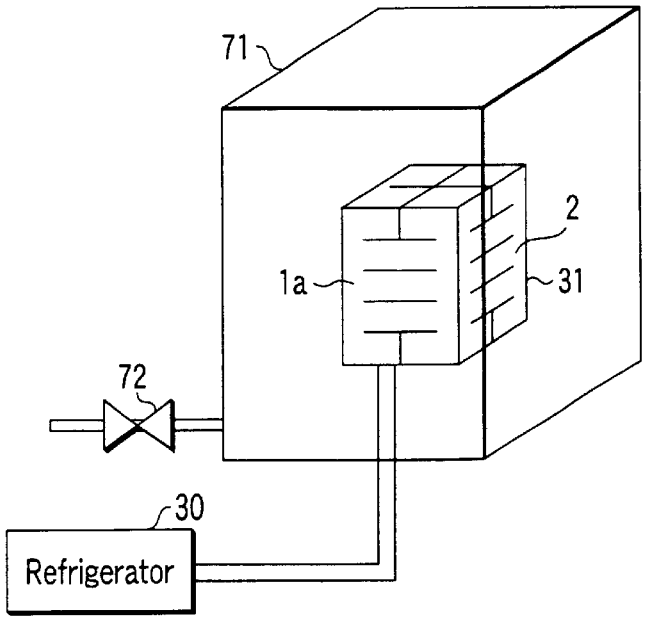
FIG. 18 is a perspective view showing a heat-insulating container housing a cold head equipped with a transmitter filter, and a receiver filter shown in FIG. 17.

As shown in FIG. 18, the cold head 31 having the transmitter filters 1*a*, 1*b*, the receiver filter 2 and the synthesizer 61 mounted thereto is housed in the heat-insulating container 71. The exhaust port 72 is formed in the heat-insulating container 71. Also, a coolant is supplied from the refrigerator 30 arranged outside the heat-insulating container 71 into the cold head 31. It is particularly desirable for the cold head 31 to be formed of a hollow polyhedral body because in this case the temperature gradient is scarcely generated so as to make it possible to render the filters highly uniform in the cooling conditions. It follows that it is possible to prevent the change in the filter characteristics of the superconductor filter derived from unevenness in temperature of the cold head 31.

Figure 19:
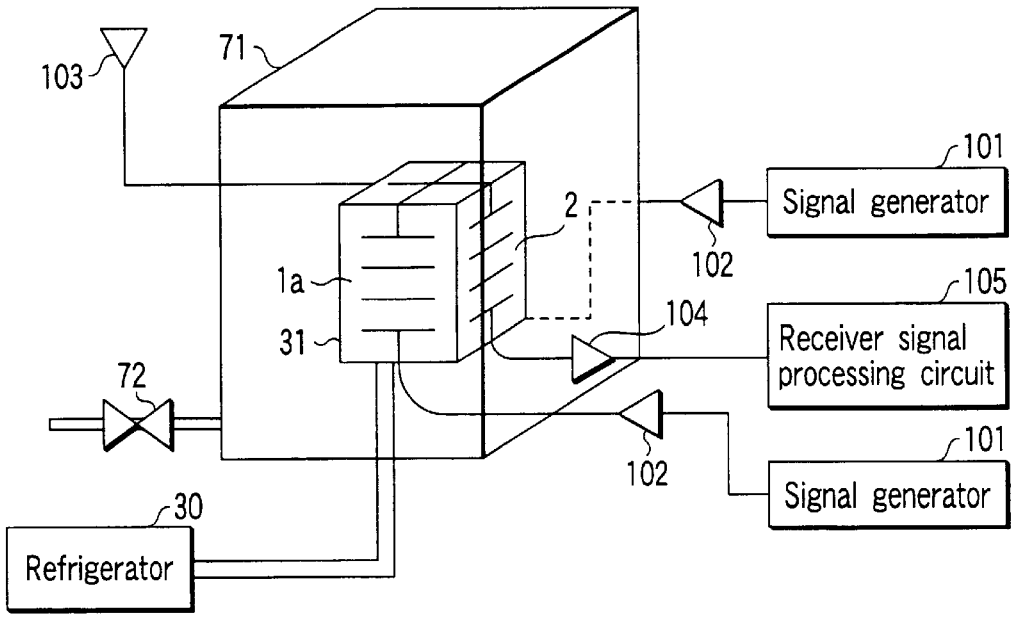
FIG. 19 shows the construction of a radio transmitter-receiver apparatus in which the transmitter filter and the receiver filter shown in FIG. 18 are incorporated.

FIG. 19 shows a radio transmitter-receiver apparatus in which the transmitter filters 1*a*, 1*b* and the receiver filter 2 shown in FIG. 18 are incorporated. As shown in FIG. 19, the low-noise amplifier (LNA) 104 is housed in the heat-insulating container 71 together with the cold head 31 having the transmitter filters 1*a*, 1*b*, the receiver filter 2 and the synthesizer 61 mounted thereto. The low-noise amplifier (LNA) 104 is connected to the receiver signal processing circuit 105 arranged outside the heat-insulating container 71.

A set of the signal generator 101 and the power amplifier (PA) 102 arranged outside the heat-insulating container 71 is connected to the input line of the transmitter filter 1*a*. Likewise, another set of the signal generator 101 and the power amplifier (PA) 102 arranged outside the heat-insulating container 71 is connected to the input line of the transmitter filter 1*b*. Further, the terminal of the synthesizer 61 is connected to the antenna 103 arranged outside the heat-insulating container 71.

In the radio transmitter-receiver apparatus shown in FIG. 19, the cold head 31 is cooled to about 60 K, with the result that it is possible to obtain the filter characteristics as designed because the filters are equal to each other in the cooling conditions. Also, when actual transmitter-receiver signals are passed, noise is scarcely mixed in the output of the receiver filter so as to ensure an SN ratio not smaller than 60 dB.

Figure 20:
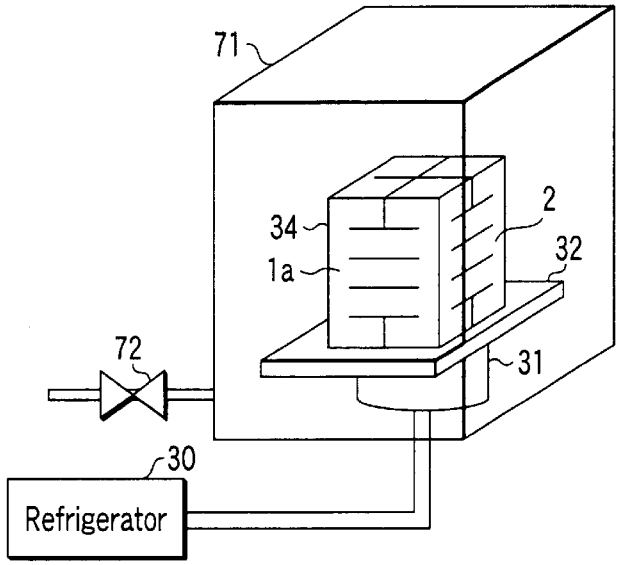
FIG. 20 is a perspective view showing another embodiment of a heat-insulating container housing a transmitter filter and a receiver filter.

It is possible to cool the transmitter filters 1*a*, 1*b* and the receiver filter 2 by a method as shown in FIG. 20. In this case, the transmitter filters 1*a*, 1*b* and the receiver filter 2 are mounted to three side surfaces of the polyhedral holding member 34, and the synthesizer 61 is mounted to the upper surface of the holding member 34. Further, the cold head 31 is arranged within the heat-insulating container 71, and the cooling plate 32 and the holding member 34 having the transmitter filters 1*a*, 1*b*, the receiver filter 2 and the synthesizer 61 mounted thereon are disposed in the order mentioned on the cold head 31.

Example 10

Figure 21:
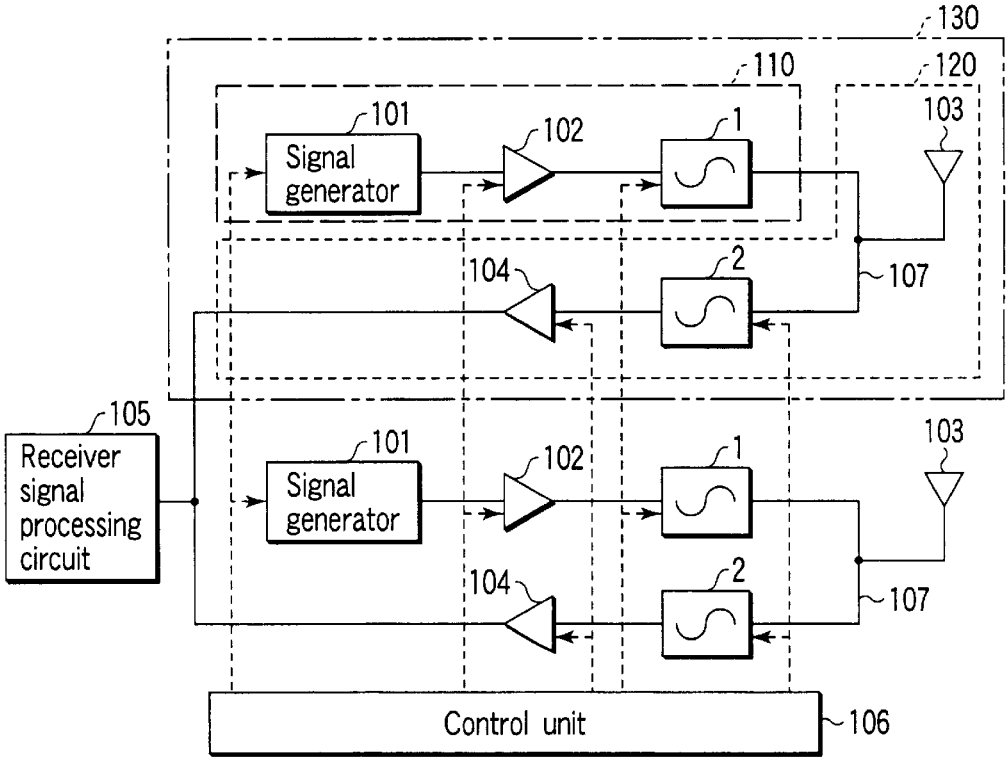
FIG. 21 is a block diagram showing the construction of the radio transmitter-receiver apparatus in Example 10 of the present invention.

FIG. 21 is a block diagram showing a radio transmitter-receiver apparatus of an individual amplifying system according to one embodiment of the present invention. The radio transmitter-receiver apparatus comprises two transmitter-receiver units 130. Each transmitter-receiver unit 130 includes at least one transmitter unit 110 and one receiver unit 120, which are connected in parallel to the antenna 103. The two receiver units 120 included in the two transmitter-receiver units 130 are connected in parallel to the single receiver signal processing circuit 105.

The transmitter unit 110 includes the signal generator 101, the power amplifier (PA) 102, and the transmitter filter 1. The signal passing through the transmitter filter 1 is power-synthesized in the synthesizer 107 and, then, sent from the antenna 103. The received signal incident on the antenna 103 is processed in the receiver unit 120. The receiver unit 120 includes the receiver filter 2 and the low-noise amplifier (LNA) 104.

The signal generator 101 generates signals of a single carrier frequency. The signal generator 101 includes, for example, a base band signal processing section for converting a transmitting data signal into a desired digital modulated signal, a D/A converter for converting the digital modulated signal into an analog modulated signal, and a modulator for converting the analog modulated signal into a signal of a carrier frequency band for the communication.

The power amplifier (PA) 102 amplifies the signal of the carrier frequency band generated from the signal generator 101 to a predetermined transmitting power level and transmits the amplified signal to the transmitter filter 1.

It is desirable for the transmitter filter 1 to have the function of shifting the center frequency of the pass band having a fixed bandwidth in accordance with the control signal generated from the control unit 106. The control unit 106 selects the center frequency in the pass band of the transmitter filter 1 depending on the control signal such that only the signal of a desired carrier frequency, which is selected from a plurality of carrier frequencies used for transmission, can be passed through the transmitter filter 1.

The transmitter units 110 including the signal generator 101, the power amplifier 102 and the transmitter filter 1 are arranged in the number corresponding to the number of carrier frequencies that can be used. The pass band of each transmitter filter 1 corresponds to each of the different carrier frequencies. The signal passing through each transmitter filter 1 is power-synthesized in the synthesizer 104 and, then, sent from the antenna 103.

In a radio communication system such as a cellular phone system, the number of carrier frequencies that can be used in the individual base stations differs depending on the number of calls generated within a cell covered by the base station. Therefore, the control unit 106 is capable of changing the pass band of each transmitter filter 1, as required, in the case where the number of carrier frequencies used in the base station is changed.

As described above, the single transmitter unit 110 is operated in the individual amplifying system for amplifying only the signal of one carrier frequency and, thus, is capable of utilizing the merit of this system.

Also, in the radio transmitter-receiver apparatus in this Example, two receiver units 120 are connected in parallel to the single receiver signal processing circuit 105. Therefore, it is possible to conform to the diversity system that can select the signal of a good received state from the signals received by the two sets of antennas 103 and the transmitter unit 120 by using RSSI (receive signal strength indicator).

Example 11

Figure 22A:
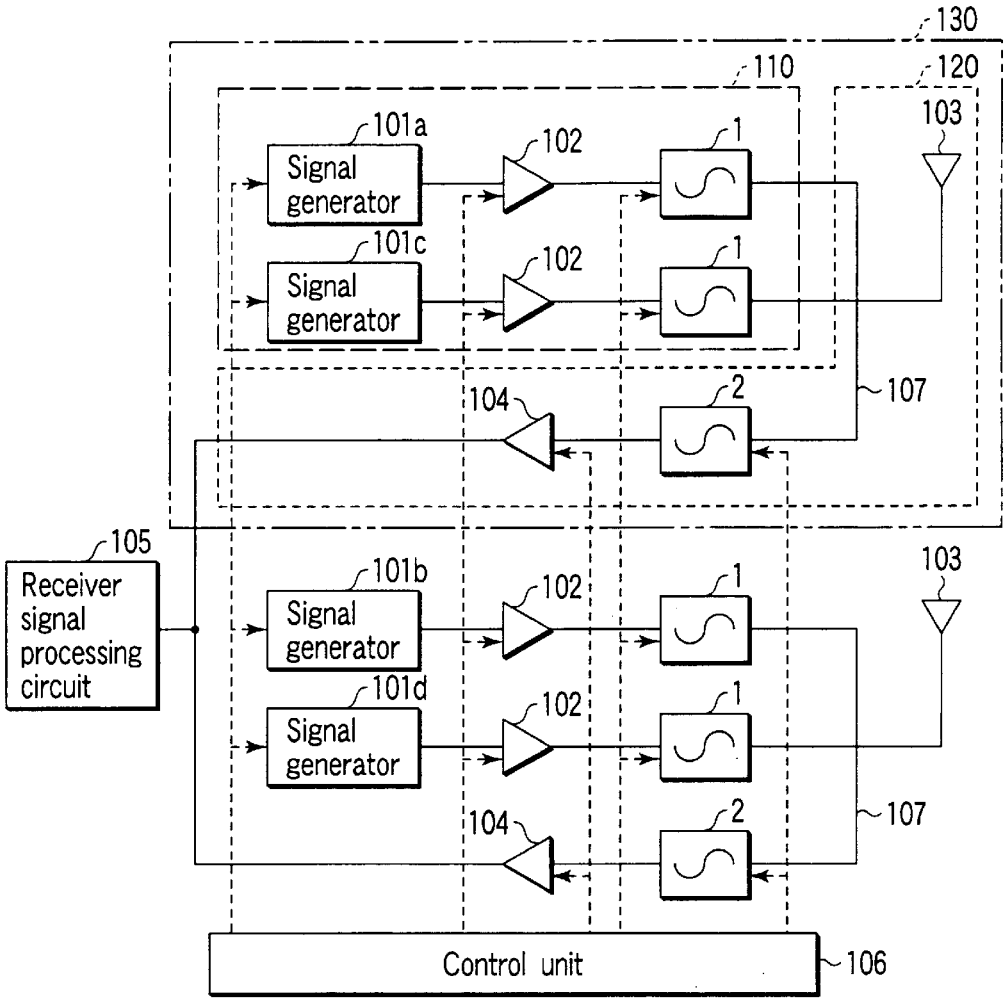
FIG. 22A is a block diagram showing the construction of the radio transmitter-receiver apparatus in Example 11 of the present invention.

FIG. 22A is a block diagram showing a radio transmitter-receiver apparatus according to another embodiment of the present invention. The radio transmitter-receiver apparatus includes two radio transmitter-receiver units 130. Each radio transmitter-receiver unit 130 includes two transmitter units 110 and the single receiver unit 120 connected in parallel to the single antenna 103. The two receiver units 120 included in the two transmitter-receiver units 130 are connected in parallel to the single receiver signal processing circuit 105. The construction of each transmitter unit 110 and the receiver unit 120 is equal to those shown in FIG. 21.

As described above, in order to alleviate the skirt characteristics of the superconductor transmitter filters connected in parallel to a single synthesizer, it is desirable to ensure a frequency band separation of at least 500 kHz, preferably about 1 MHz, between the adjacent carrier frequency bands passing through respective superconductor transmitter filters.

Figure 22B:
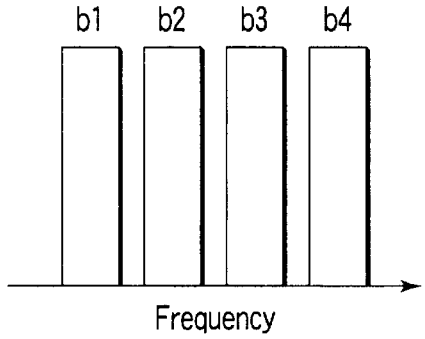
FIG. 22B shows how to divide the frequency band.

In this Example, a band of 20 MHz is divided into four bands each having a bandwidth of 5 MHz starting with the lower frequency, as shown in FIG. 22B. The bands in FIG. 22B are referred to as bands b1, b2, b3 and b4. The signals of bands b1 and b3 are used in the signal generators 101*a*, 101*c* of the two transmitter units 110 included in one of the transmitter-receiver units 130, and the bands b2 and b4 are used in the signal generators 101*b*, 101*d* of the two transmitter units 110 included in the other transmitter-receiver unit 130. As a result, the high frequency edge and the low frequency edge of the two carrier frequencies synthesized by the synthesizer 107 are apart from each other by 5 MHz in any of the transmitter-receiver unit 130. It follows that the demands for the skirt characteristics of the superconductor filter are alleviated. In addition, since no vacancy in the frequency band is generated as a whole, the transmission frequency band can be effectively utilized.

Also, if the two transmitter-receiver units each having two transmitter filters 1 and one receiver filter 2 connected in parallel are connected in parallel as shown in FIG. 22A, it is possible to obtain a merit described below, compared with the case where four transmitter filters 1 and one receiver filter 2 are connected in parallel as shown in FIG. 13. Specifically, suppose that a synthesizer is formed by using a metal thin film and the impedance of the synthesizer is designed at 50 Ω in FIG. 13. In general, used is a substrate having a thickness not larger than 1 mm and, thus, the line width of the synthesizer is not larger than 1 mm. In this case, a large current flows through the synthesizer for synthesizing the output of the four transmitter filters and, thus, the synthesizer is exposed to severe conditions, with the result that a high resistance to power is required for the synthesizer. In the circuit shown in FIG. 22A, however, only two transmitter filters 1 are connected to the single synthesizer 107, with the result that the load applied to the synthesizer 107 is alleviated.

Figure 23:
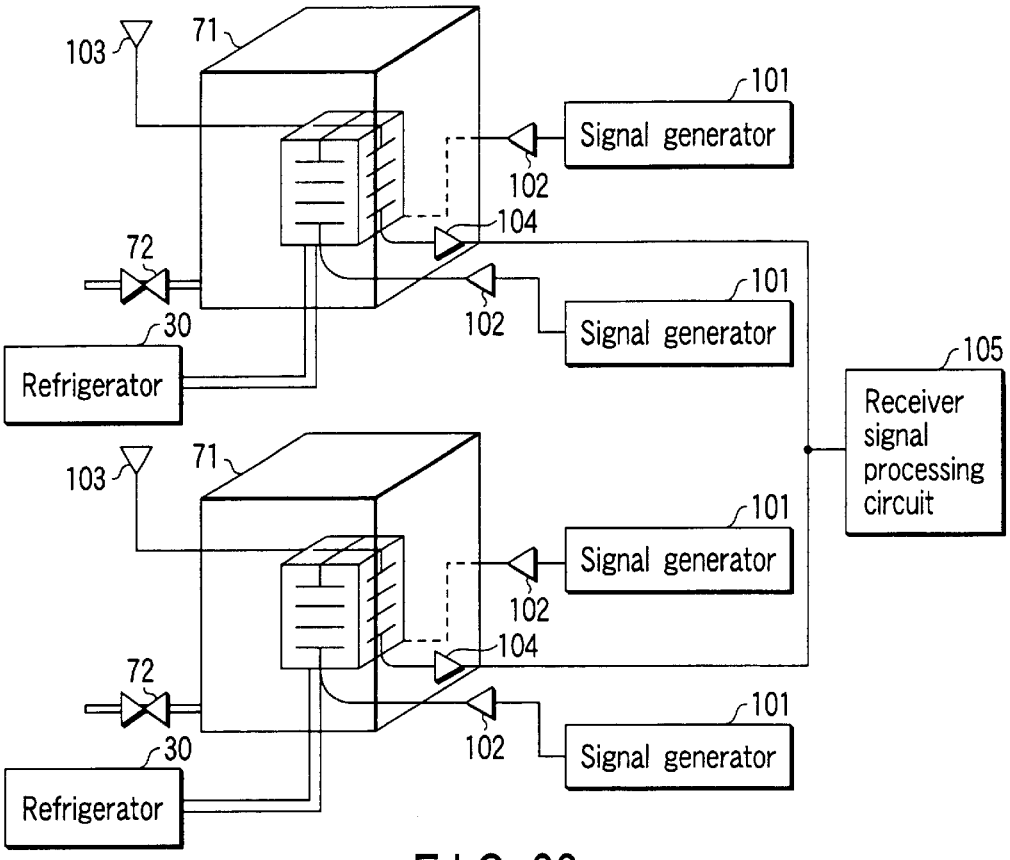
FIG. 23 shows an embodiment of the radio transmitter-receiver apparatus in Example 11 of the present invention.

FIG. 23 shows an example of the radio transmitter-receiver apparatus shown in FIG. 22. The radio transmitter-receiver apparatus is constructed such that two transmitter-receiver units 130 shown in FIG. 19 are connected in parallel and the receiver units for these radio transmitter-receiver units 130 are connected to the single receiver signal processing circuit 105. In FIG. 23, the two transmitter-receiver units 130 are housed in different heat-insulating containers 71.

Figure 24:
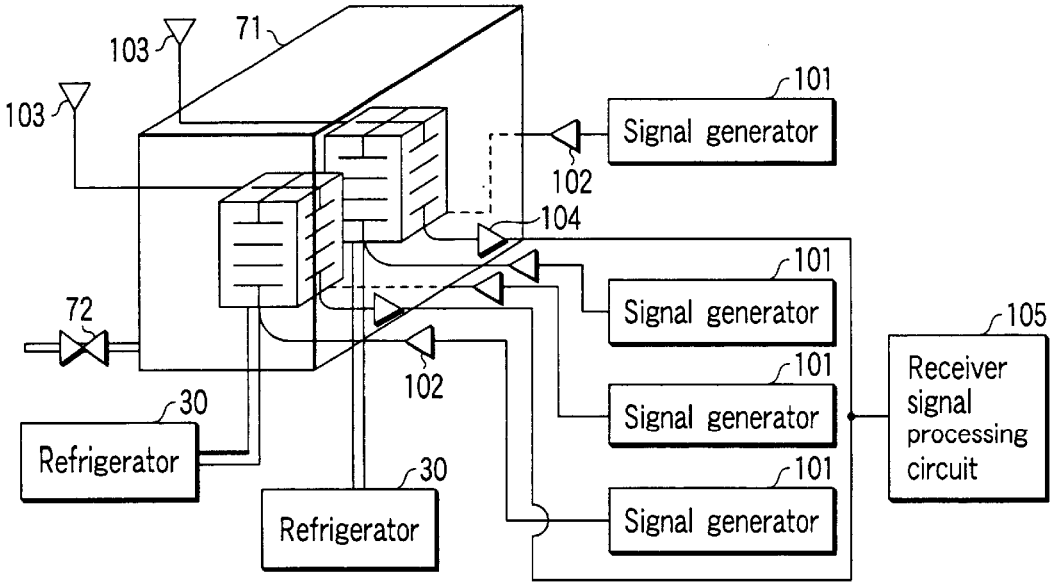
FIG. 24 shows another embodiment of the radio transmitter-receiver apparatus in Example 11 of the present invention.

FIG. 24 shows another example of the radio transmitter-receiver apparatus shown in FIG. 22. The radio transmitter-receiver apparatus shown in FIG. 24 is equal in construction to the apparatus shown in FIG. 23, except that the two radio transmitter-receiver units 130 are housed in the single heat-insulating container 71.

In the radio transmitter-receiver apparatus of the present invention, it is desirable to provide a detector for detecting a defect that has taken place in any of equipment of each of the transmitter-receiver units. Based on the detection result of the detector, the control unit disconnects the transmitter-receiver unit including defective equipment, and the apparatus is controlled such that its operation can be continued utilizing the remaining transmitter-receiver units. If such a detector is provided, it is possible to perform the operation by utilizing the normal transmitter-receiver units so as to realize a radio transmitter-receiver apparatus having a high reliability.

Also, if the superconductor filters are separated into a plurality of groups and cooled by individual refrigerators for the individual groups as shown in FIGS. 23 and 24, even when a defect has taken place in some of the refrigerators, restoring operation to the defect can be performed without stopping the operation of the entire radio transmitter-receiver apparatus.

In the radio transmitter-receiver apparatus of the present invention, it is desirable for the center frequency and the bandwidth of the filter to be variable based on the control signal generated from the control unit. For example, for performing the data transmission at a relatively low rate in the case of sound data and the data transmission at a relatively high rate in the case of moving picture data, the spread bandwidth of the individual carrier is controlled in a variable manner in accordance with the transmission rate.

It is desirable for the radio transmitter-receiver apparatus of the present invention to include a power meter measuring the power of the individual carrier frequency signals and a temperature monitor monitoring the temperature of each superconductor filter. The efficiency of the refrigerator used for cooling each superconductor filter is varied using the control unit based on the measurement results from the power meter and the temperature monitor. The number of carrier frequencies used and the transmitting power differ with time and, thus, heat generation of each filter also differs. Under the circumstances, it is possible to operate the refrigerator efficiently by varying refrigeration capacity in accordance with the heat generation of the filter so as to achieve power saving. It should also be noted that there is a slight time difference caused by heat conduction between the timing of the heat generation from the filter and the timing of the temperature measurement. There is a possibility that a predetermined temperature control fails to be achieved because of the time difference noted above so as to cause fluctuation of the frequency. With respect to this difficulty, it is also possible to stabilize the frequency if the refrigeration capacity can be varied depending on the result of the power measurement. Further, where the transmitting power is known in advance, it is possible for the control unit to vary the refrigeration capacity in accordance with the output timing of each of the signal generator and the filter.

Additional advantages and modifications will readily occur to those skilled in the art. Therefore, the present invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A superconductor filter, comprising:

a superconductor receiver filter of a planar transmission line structure including a signal input line, a resonator element and a signal output line, and configured to select a signal received from an antenna;

a superconductor transmitter filter of a planar transmission line structure including a signal input line, a resonator element and a signal output line, and configured to select a signal transmitted to the antenna, a direction of the transmitter filter being arranged non-parallel to a direction of the receiver filter; and a heat-insulating container housing the superconductor receiver filter and the superconductor transmitter filter.

2. The superconductor filter according to claim 1, wherein the receiver filter and the transmitter filter are arranged at positions in rotational symmetry with respect to the position of the lowest or highest temperature of a planar cooling member.

3. The superconductor filter according to claim 2, wherein the receiver filter and the transmitter filter are arranged substantially perpendicular to each other.

4. The superconductor filter according to claim 1, wherein the superconductor receiver filter and the superconductor transmitter filter are arranged apart from each other by a distance of about a wavelength of the transmitting signals.

5. The superconductor filter according to claim 1, wherein the transmitter filter and the receiver filter are arranged substantially perpendicular to each other.

6. A superconductor filter, comprising:

a superconductor receiver filter of a planar transmission line structure including a signal input line, a resonator element and a signal output line, and configured to select a signal received from an antenna;

a superconductor transmitter filter of a planar transmission line structure including a signal input line, a resonator element and a signal output line, and configured to select a signal transmitted to the antenna, the transmitter filter being arranged in a position out of alignment with the receiver filter along a signal transmitting direction; and a heat-insulating container housing the superconductor receiver filter and the superconductor transmitter filter.

7. The superconductor filter according to claim 6, wherein the superconductor receiver filter and the superconductor transmitter filter are arranged apart from each other by a distance of about a wavelength of the transmitting signals.

8. A superconductor filter, comprising:

a polyhedral cooling member;

a superconductor receiver filter of a planar transmission line structure including a signal input line, a resonator element and a signal output line, and configured to select a signal received from an antenna, the receiver filter being mounted on one surface of the cooling member;

a superconductor transmitter filter of a planar transmission line structure including a signal input line, a resonator element and a signal output line, and configured to select a signal transmitted to the antenna, the transmitter filter being mounted on another surface of the cooling member differing from the surface on which the superconductor receiver filter is mounted; and a heat-insulating container housing the cooling member, the superconductor receiver filter and the superconductor transmitter filter.

9. The superconductor filter according to claim 8, wherein the superconductor receiver filter and the superconductor transmitter filter are arranged apart from each other by a distance of about a wavelength of the transmitting signals.

10. The superconductor filter according to claim 8, wherein the receiver filter and the transmitter filter are connected in parallel through a superconductor.

11. The superconductor filter according to claim 8, wherein the cooling member is a parallelepiped, and the receiver filter and the transmitter filter are mounted on adjacent side surfaces of the parallelepiped cooling member.

12. A radio transmitter-receiver apparatus configured to perform communication by using at least two carrier frequencies, comprising:

a plurality of radio transmitter-receiver units each including at least one transmitter unit and at least one receiver unit connected in parallel to a single antenna, the transmitter unit including a signal generator generating a signal of one carrier frequency used for communication, an amplifier amplifying the signal of the carrier frequency, and a superconductor transmitter filter filtering a signal of a predetermined band from the amplified signal, which are connected in cascade connection, and the receiver unit including a superconductor receiver filter filtering a signal of a predetermined band from a signal of a single carrier frequency received by the antenna and an amplifier amplifying the signal of the predetermined band, which are connected in cascade connection; and a single receiver signal processing circuit to which the receiver units included in the plurality of radio transmitter-receiver units are connected in parallel.

13. The apparatus according to claim 12, wherein the radio transmitter-receiver unit includes two transmitter units and a single receiver unit, which are connected in parallel, the two transmitter units using carrier frequency bands differing from each, and the high frequency edge and the lower frequency edge of the two carrier frequency bands being apart from each other by at least 500 kHz.

14. The apparatus according to claim 12, wherein the superconductor receiver filter and the superconductor transmitter filter are arranged non-parallel to each other and apart from each other by a distance of about a wavelength of transmitting signals in a heat-insulating container.

15. The apparatus according to claim 12, wherein the superconductor receiver filter and the superconductor transmitter filter are arranged in positions out of alignment along a signal transmitting direction and apart from each other by a distance of about a wavelength of the transmitting signals in a heat-insulating container.

16. The apparatus according to claim 12, wherein the superconductor receiver filter and the superconductor transmitter filter are mounted on different surfaces of a polyhedral cooling member and apart from each other by a distance of about a wavelength of the transmitting signals in a heat-insulating container.

* * * * *